US011999545B2

(12) United States Patent
Helseth

(10) Patent No.: US 11,999,545 B2
(45) Date of Patent: Jun. 4, 2024

(54) TWIST-TIE PRODUCT

(71) Applicant: Twist-Ease, Inc., Crystal, MN (US)

(72) Inventor: James R. Helseth, Plymouth, MN (US)

(73) Assignee: Twist-Ease, Inc., Crystal, MN (US)

( * ) Notice: Subject to any disclaimer, the term of this patent is extended or adjusted under 35 U.S.C. 154(b) by 0 days.

(21) Appl. No.: 18/192,829

(22) Filed: Mar. 30, 2023

(65) Prior Publication Data

US 2023/0382614 A1 Nov. 30, 2023

Related U.S. Application Data

(63) Continuation of application No. 17/381,785, filed on Jul. 21, 2021, now abandoned, which is a continuation of application No. 16/745,919, filed on Jan. 17, 2020, now abandoned, which is a continuation of application No. 15/457,183, filed on Mar. 13, 2017, now Pat. No. 10,538,372.

(60) Provisional application No. 62/307,766, filed on Mar. 14, 2016.

(51) Int. Cl.

| | |
|---|---|
| ***B65D 63/10*** | (2006.01) |
| ***A47F 13/00*** | (2006.01) |
| ***B65D 33/16*** | (2006.01) |
| ***B65D 63/04*** | (2006.01) |

(52) U.S. Cl.

CPC ..... *B65D 63/04* (2013.01); *A47F 13/00* (2013.01); *B65D 33/1616* (2013.01); *B65D 2563/00* (2013.01); *Y10T 24/157* (2015.01)

(58) Field of Classification Search

CPC B65D 63/04; B65D 33/1616; B65D 2563/00; A47F 13/00; Y10T 24/157; Y10T 24/149

See application file for complete search history.

(56) References Cited

U.S. PATENT DOCUMENTS

| | | | |
|---|---|---|---|
| 1,441,359 | A | 1/1923 | Langston |
| 2,050,394 | A | 8/1936 | Straubel |
| D156,922 | S | 1/1950 | Sonntag |
| 2,973,597 | A | 3/1961 | Powell |
| 2,984,161 | A | 5/1961 | Cook et al. |

(Continued)

FOREIGN PATENT DOCUMENTS

| | | |
|---|---|---|
| WO | 2005/035381 A1 | 4/2005 |

OTHER PUBLICATIONS

International Search Report and Written Opinion for Application No. PCT/US2017/022138 dated Jul. 6, 2017.

(Continued)

*Primary Examiner* — Jonathan Malikasim
*Assistant Examiner* — Michael S Lee
(74) *Attorney, Agent, or Firm* — Merchant & Gould P.C.

(57) ABSTRACT

A twist-tie includes a fastener having a malleable material surrounded by an outer coating having a longitudinal axis and extending between a first end and a second end; and an indicia portion extending at least partially along the longitudinal axis, the indicia portion including at least a portion that is attached to the fastener and at least a portion that is separated from the fastener, wherein a separation between the indicia portion and the fastener defines a slit that extends from an open end toward a closed end in a direction of at least one of the first end toward the second end and the second end toward the first end.

5 Claims, 2 Drawing Sheets

(56) References Cited

U.S. PATENT DOCUMENTS

| | | | | |
|---|---|---|---|---|
| 3,068,135 | A | 12/1962 | Bower | |
| 3,207,564 | A | 9/1965 | Patrick et al. | |
| 3,290,854 | A | 12/1966 | MacMurray | |
| 3,409,948 | A | 11/1968 | Goodwin | |
| 3,685,482 | A | 8/1972 | Ryder | |
| 3,774,755 | A | 11/1973 | Cast et al. | |
| 3,973,234 | A | 8/1976 | Youtsey et al. | |
| 3,973,294 | A * | 8/1976 | Pfizenmaier | B65D 33/30 383/905 |
| 3,973,594 | A | 8/1976 | Gustafsson et al. | |
| 4,052,886 | A | 10/1977 | Buick | |
| D261,452 | S | 10/1981 | Chandler | |
| 4,509,231 | A | 4/1985 | Paxton | |
| 4,529,636 | A | 7/1985 | Olsen | |
| 4,537,330 | A | 8/1985 | Gelbard | |
| 4,543,862 | A | 10/1985 | Levene et al. | |
| 4,558,813 | A | 12/1985 | Richards | |
| 4,596,195 | A | 6/1986 | Wenger | |
| D285,719 | S | 9/1986 | Conlon | |
| 4,621,732 | A | 11/1986 | Olson | |
| D294,908 | S | 3/1988 | Childress | |
| 4,815,610 | A | 3/1989 | Borick et al. | |
| 4,915,996 | A | 4/1990 | Curry | |
| 4,948,202 | A | 8/1990 | Helseth | |
| D323,594 | S | 2/1992 | Helseth | |
| 5,092,830 | A | 3/1992 | Helseth | |
| 5,213,400 | A | 5/1993 | Helseth | |
| 5,232,431 | A | 8/1993 | Helseth | |
| 5,732,495 | A | 3/1998 | Lowe et al. | |
| D395,566 | S | 6/1998 | Helseth | |
| 5,871,115 | A | 2/1999 | Kohn | |
| 5,961,434 | A | 10/1999 | Helseth | |
| 6,217,500 | B1 | 4/2001 | Helseth et al. | |
| 10,538,372 | B2 | 1/2020 | Helseth | |
| 10,875,349 | B2 | 12/2020 | O'Donnell et al. | |
| 2010/0310834 | A1 | 12/2010 | Buselli | |
| 2014/0217718 | A1 * | 8/2014 | O'Donnell | G09F 3/0295 493/324 |
| 2015/0034513 | A1 | 2/2015 | Helseth | |
| 2017/0112297 | A1 | 4/2017 | Helseth et al. | |
| 2021/0070089 | A1 | 3/2021 | O'Donnell et al. | |

OTHER PUBLICATIONS

U.S. Pat. No. 628,642 Issued Jul. 11, 1899 to Wyman.
U.S. Pat. No. 740,001 Issued Sep. 29, 1903 to Flanagin.

* cited by examiner

TWIST-TIE PRODUCT

CROSS-REFERENCE TO RELATED APPLICATION

The present application is a continuation of U.S. patent application Ser. No. 17/381,785, filed Jul. 21, 2021, now abandoned; which is a continuation of U.S. patent application Ser. No. 16/745,919, filed Jan. 17, 2020, now abandoned; which is a continuation of U.S. patent application Ser. No. 15/457,183, filed Mar. 13, 2017, now U.S. Pat. No. 10,538,372; which claims the benefit of U.S. Provisional Patent Application Ser. No. 62/307,766, filed Mar. 14, 2016, which applications are hereby incorporated by reference in their entireties.

FIELD

The present disclosure relates generally to twist-tie fasteners and methods of use.

BACKGROUND

There are many uses for twist-ties. In a grocery store, for example, consumers commonly place produce items, bakery items, bulk food items, and the like in bags and use twist-ties to temporarily close the bags. Cost-effective manufacture, refill, or replacement of the twist-ties is advantageous.

For the reasons stated above and for other reasons stated below, which will become apparent to those skilled in the art upon reading and understanding the present specification, there is a need in the art for an improved twist-tie fastener.

SUMMARY

The following summary is made by way of example and not by way of limitation. It is merely provided to aid the reader in understanding some of the aspects of the inventive features.

In one embodiment, the twist-tie fastener includes an indicia portion that can be used by consumers to provide indicia on the twist-tie in addition to the fastening function of the twist-tie. The indicia portion may include a blank space/area for the consumers to write notes, label the goods, and apply other indicia thereon. The indicia portion may include pre-applied or printed indicia such as coupon codes, advertising, or trademarks.

The twist-ties of the present disclosure may be provided in a cluster, wherein a plurality of the twist-ties are attached to the cluster by methods such as by adhesive. The cluster, once spent, may be disposed from a dispenser unit and replaced. The dispenser unit itself may be configured as a disposable product, wherein the dispenser can be thrown away or disposed of once the twist-tie cluster is spent. Conventional twist-tie dispensers may comprise a housing and a twist-tie cluster attached to the housing. The housing may include a generally U-shaped portion forming a pocket that is for receiving the twist-tie cluster. A rear portion or wall of the housing may define mounting members used for mounting the housing to a fixture at a consumer location such as a grocery store.

According to one example embodiment, the twist-tie of the present disclosure includes a fastener portion extending between a first end and a second end and an indicia portion extending at least partially along the fastener portion, the indicia portion including at least a portion that is attached to the fastener portion and at least a portion that is separated from the fastener portion by a slit, the slit extending from an open end toward a closed end in a direction of at least one of the first end toward the second end and the second end toward the first end.

According to another example embodiment of the twist-tie of the present disclosure, the twist-tie includes a fastener portion extending between a first end and a second end and an indicia portion extending at least partially along the fastener portion, the indicia portion including at least a portion that is attached to the fastener portion and at least a portion that is separated from the fastener portion by a first slit extending from an open end toward a closed end in the direction of the first end toward the second end and a second slit extending from an open end toward a closed end in the direction of the second end toward the first end.

According to another example embodiment of a twist-tie of the present disclosure, the twist-tie includes a fastener including a malleable material surrounded by an outer coating having a longitudinal axis and extending between a first end and a second end and an indicia portion extending at least partially along the longitudinal axis, the indicia portion including at least a portion that is attached to the fastener and at least a portion that is separated from the fastener, wherein a separation between the indicia portion and the fastener defines a slit that extends from an open end toward a closed end in a direction of at least one of the first end toward the second end and the second end toward the first end.

According to another example aspect, the present disclosure is directed to an inventive twist-tie cluster. The twist-tie cluster of the present disclosure includes a plurality of twist-ties defining the cluster, each twist-tie comprising a fastener portion extending between a first end and a second end and an indicia portion extending at least partially along the fastener portion, the indicia portion including at least a portion that is attached to the fastener portion and at least a portion that is separated from the fastener portion by a slit, the slit extending from an open end toward a closed end in a direction of at least one of the first end toward the second end and the second end toward the first end.

According to one example embodiment of the twist-tie cluster of the present disclosure, the twist-tie cluster includes a plurality of twist-ties defining the cluster, wherein the plurality of twist-ties defines twist-tie pairs. Each twist-tie of the pair defines a fastener portion extending along a longitudinal direction between a first end and a second end and an indicia portion extending at least partially along the fastener portion, the indicia portion including at least a portion that is attached to the fastener portion and at least a portion that is separated from the fastener portion by a slit, the slit extending from an open end toward a closed end in a direction of at least one of the first end toward the second end and the second end toward the first end. The twist-ties of each pair are positioned on the cluster so as to at least partially overlap along the longitudinal direction.

According to yet another example embodiment of a twist-tie cluster of the present disclosure, the twist-tie cluster includes a plurality of twist-ties defining the cluster, each twist-tie comprising a fastener including a malleable material surrounded by an outer coating having a longitudinal axis and extending between a first end and a second end and an indicia portion extending at least partially along the longitudinal axis, the indicia portion including at least a portion that is attached to the fastener and at least a portion that is separated from the fastener, wherein a separation between the indicia portion and the fastener defines a slit that extends from an open end toward a closed end in a direction of at least one of the first end toward the second end and the second end toward the first end.

BRIEF DESCRIPTION OF THE DRAWINGS

The inventive aspects of the present disclosure can be more easily understood, and further advantages and uses thereof can be more readily apparent, when considered in view of the detailed description and the following Figures in which.

In accordance with common practice, the various described features may not be drawn to scale but are drawn to emphasize specific inventive features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration, embodiments in which the inventions may be practiced. These embodiments are described in sufficient detail to enable those skilled in the art to practice the inventive features, and it is to be understood that other embodiments may be utilized and mechanical changes may be made without departing from the spirit and scope of the present disclosure. The following detailed description is, therefore, not to be taken in a limiting sense, and the scope of the present inventive features are defined only by the claims and equivalents thereof.

Embodiments of the present disclosure provide improved twist-tie fasteners.

Figure 1:
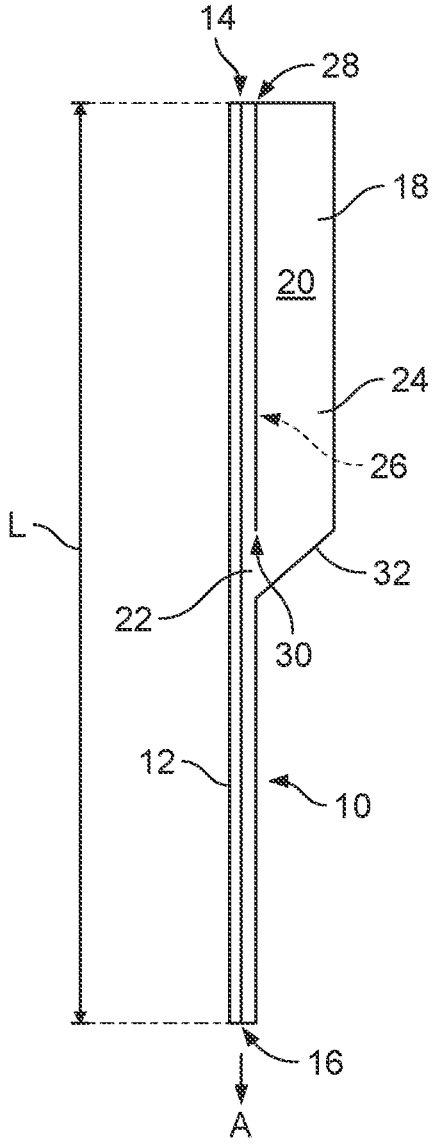
FIG. 1 illustrates a first embodiment of a twist-tie fastener having features that are examples of inventive aspects in accordance with the present disclosure.

A first embodiment of a twist-tie 10 having features that are examples of inventive aspects is illustrated in FIG. 1. The twist-tie 10, as shown, defines a fastener portion 12 extending between a first end 14 and a second end 16. The fastener portion 12 extends along a longitudinal axis A and defines a length L between the first and second ends 14, 16. The fastener portion 12 of the twist-tie 10 provides the closure function for the twist-tie 10 and, in certain examples, includes a malleable material surrounded by an outer coating. According to certain examples, the malleable material can be manufactured from various metals and the outer coating may be of paper or polymeric construction.

Still referring to FIG. 1, the twist-tie 10 of the present disclosure also includes an indicia portion 18 extending at least partially along the fastener portion 12 of the twist-tie 10. The indicia portion 18 provides an area or space 20 for the application of indicia. For example, the indicia portion 18 may be used by the consumers to provide indicia on the twist-tie 10 in addition to the fastening function of the twist-tie 10, where the consumers can label the packages/bags enclosed by the twist-ties, take notes, or apply other indicia thereon. In contrast to consumer use, the area 20 provided by the indicia portion 18 may be used for branding and include pre-applied or printed indicia such as coupon codes, advertising, or trademarks.

The indicia portion 18 of the twist-tie 10 includes at least a portion 22 that is attached to the fastener 12 and at least a portion 24 that is separated from the fastener 12. The separation between the indicia portion 18 and the fastener 12 of the twist-tie defines a slit 26. The slit 26 defines an open end 28 and a closed end 30 and extends between the open and closed ends 28, 30.

Figure 2:
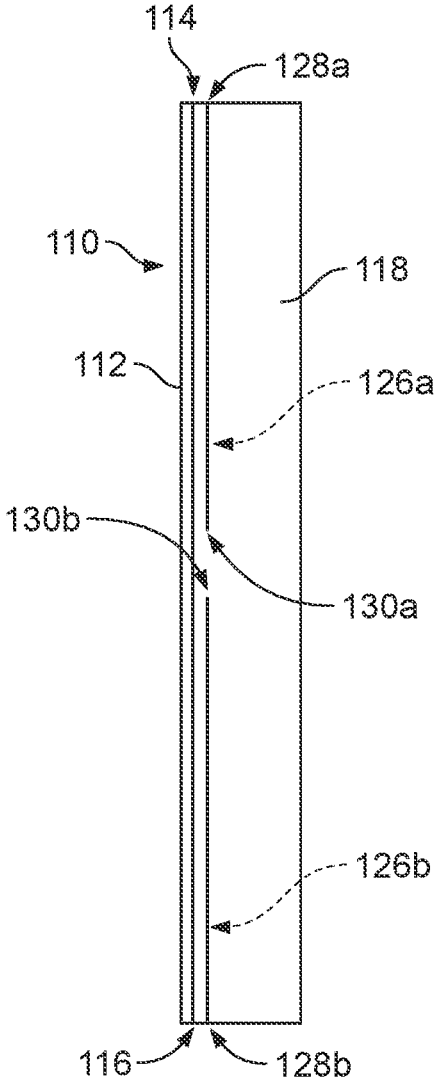
FIG. 2 illustrates another embodiment of a twist-tie fastener having features that are examples of inventive aspects in accordance with the present disclosure.

In the example embodiment shown in FIG. 1, the twist-tie 10 includes a single slit 26 that extends in a direction from the first end 14 toward the second end 16. As will be discussed in further detail below, other twist-tie designs that provide for a first slit extending from an open end toward a closed end in the direction of the first end 14 toward the second end 16 and a second slit extending from an open end toward a closed end in the direction of the second end 16 toward the first end 14 are also contemplated as shown in FIG. 2. Such designs may include indicia portions 18 that extend generally the entire length of the fastener portions 12 of the twist-ties 10 and may provide a larger area/length for application of indicia, especially pre-applied or printed indicia.

The separation of the indicia portion 18 and the fastener portion 12 of the twist-tie 10 via the slit 26 enables provision of a longer fastener portion 12 for the twist-tie 10 than would otherwise be possible by an indicia portion that was fully attached to the fastener portion 12. Thus, in this manner, the length of the usable fastener portion 12 is increased as compared to a twist-tie that does not utilize a slit. Since a longer usable portion is enabled for the fastening function, the overall length of the fastener portion 12 extending from the first end 14 to the second end 16 (as well as the overall length of the twist-tie 10) can be reduced for space savings. Conventional twist-ties that do not provide for a separation between the indicia portion and the fastener portion of the twist-tie often require a substantially longer fastener portion in order to fully utilize the closure function of the twist-tie, making the overall twist-tie longer for a given indicia portion.

As shown in the example of FIG. 1, the indicia portion 18 defines an angled side 32. The provision of the angled side 32 improves manufacturability. The angled side 32 allows a pair 34 of symmetric twist-ties 10 shown in FIG. 1 to be provided as a unit in a cluster 36 of twist-ties 10, where each twist-tie 10 of the pair 34 is positioned opposing each other and positioned so as to at least partially overlap along the longitudinal axis/direction A. When positioned in this manner, the open end 28 of the slit 26 for each twist-tie 10 of a given pair 34 is located at an opposite end of the pair 34.

Figure 3:
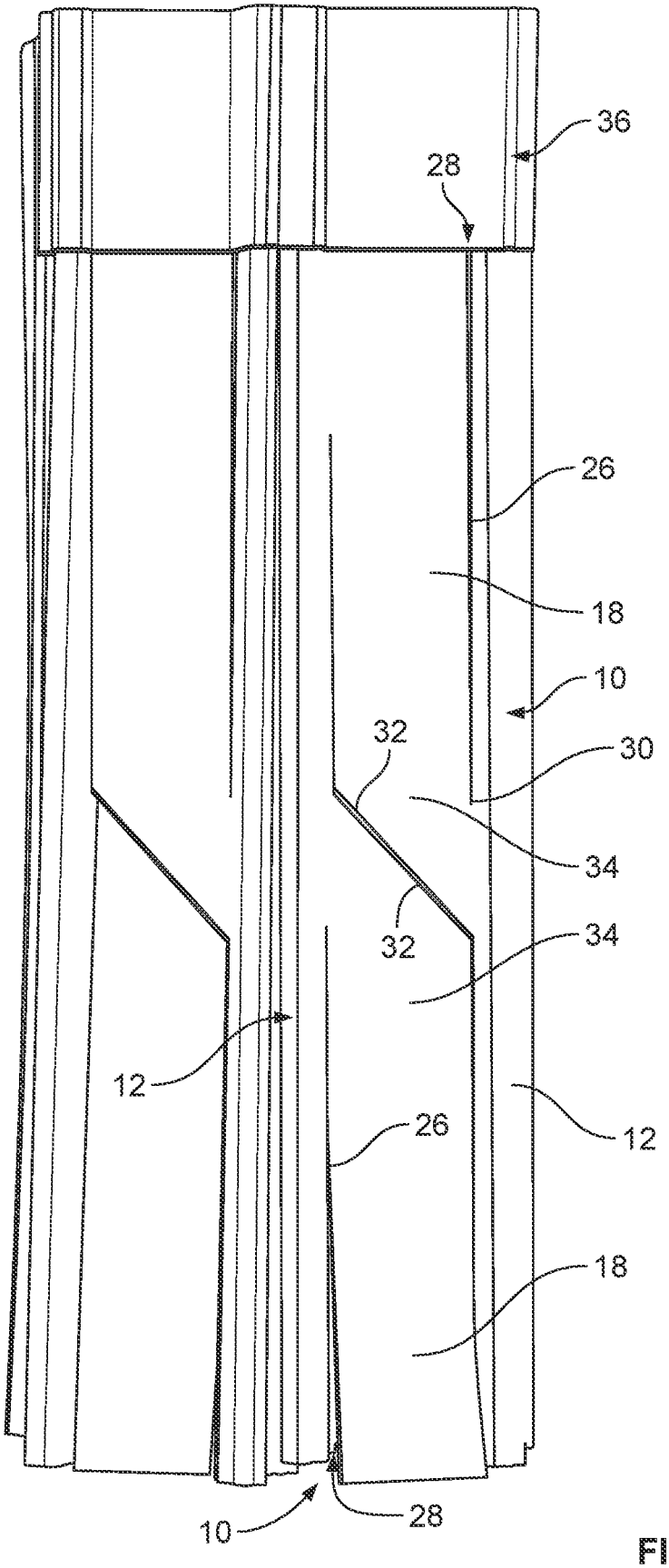
FIG. 3 illustrates an example embodiment of a twist-tie cluster formed from the twist-ties of FIG. 1.

With the specific design of the twist-tie 10 shown in FIG. 1, a blade of a manufacturing apparatus can efficiently make the required slits 26 in forming two separate twist-ties 10, each with a separate indicia portion 18, from a single given piece of paper. A twist-tie cluster 36 that includes a plurality of the described twist-tie pairs 34 is shown in FIG. 3.

Another example of a twist-tie 110 is shown in FIG. 2. As noted above, in certain examples, the twist-tie 110 may define an indicia portion 118 that extends generally along the entire length L of the fastener portion 112. Such a design provides for a first slit **126*a* extending from an open end 128*a* toward a closed end 130*a* in the direction of the first end 114 toward the second end 116 and a second slit 126*b* extending from an open end 128*b* toward a closed end 130*b* in the direction of the second end 116 toward the first end 114. This type of a design may be advantageous for providing branding on the twist-ties 110, where the branding can extend along the entire length L of the twist-tie 110, while the fastener portion 112** is used for the closure function.

Although illustrated as such, it should be noted that the open ends **128*a*, 128*b* of the slits 126*a*, 126*b* do not have to be adjacent the ends 114, 116 of the fastener portion 112. The indicia portions 118 do not have to extend all the way to the ends 114, 116 of the fastener portions 112** and can be provided in differing lengths/sizes. The same is applicable to all of the noted embodiments of the twist-ties.

Also, as shown in the depicted embodiments, in the twist-ties 10, 110 of the present disclosure, the closed ends of the slits are generally provided at a location that is positioned close to but at generally less than halfway along the length L of the fastener when taken in a direction from either the first end toward the second end or the second end toward the first end (see, e.g., FIG. 1). In the example of the twist-tie 110 shown in FIG. 2, the closed end 130*a* of the first slit 126*a* is positioned close to but at less than halfway along the length L when taken in a direction from the first end 114 toward the second end 116, and the closed end 130*b* of the second slit 126*b* is positioned close to but at less than halfway along the length L when taken in a direction from the second end 116 toward the first end 114. This configuration allows sufficient connection between the indicia portion 18, 118 and the fastener portion 12, 112 of the twist-tie 10, 110, while maximizing the length of the indicia portion 18, 118 along the longitudinal direction. Placing the closed end of the slit close to the center-point of the fastener 12 (in combination with an angled side 32) also allows overlapping positioning of symmetric twist-ties 10 as shown in FIG. 3 to facilitate manufacturability and provide space saving.

The invention claimed is:

1. A cluster of twist-ties comprising:

a plurality of twist-ties defining the cluster, wherein the plurality of twist-ties defines twist-tie pairs, each twist-tie of the pair comprising:

a fastener portion extending between a first end and a second end, the fastener portion configured for affixing the twist-tie on an object; and an indicia portion extending at least partially along the fastener portion, the indicia portion including at least a portion that is attached to the fastener portion and at least a portion that is separated from the fastener portion by a slit, the slit extending from an open end toward a closed end in a direction of the first end toward the second end of each twist tie of the pair, wherein the indicia portion of each twist tie of the pair is configured for application of indicia, wherein the portion of the indicia portion that is separated from the fastener portion by the slit is movable with respect to the fastener portion and with respect to said object to which the fastener portion can be affixed, wherein neither the fastener portion nor the indicia portion of each twist-tie of the pair includes any adhesive material and wherein the indicia portion cannot be fastened to said object without the fastener portion of the twist-tie, and such that the indicia portion is not configured for attachment to any object, and wherein the indicia portion of each twist tie of the pair defines a side that is angled at an acute angle relative to the direction that extends from the first end toward the second end, wherein the angled side of the indicia portion is located at an opposite side from a side of the indicia portion that is adjacent the open end formed by the slit;

wherein the twist-ties of each pair are positioned on the cluster so as to at least partially overlap along a longitudinal direction, and wherein when the twist-ties are positioned to at least partially overlap along the longitudinal direction, the angled sides of the twist-ties of the pair face each other and are adjacent each other so as to essentially abut each other.

2. A cluster according to claim 1, wherein each fastener portion includes a malleable material surrounded by an outer coating.

3. A cluster according to claim 1, wherein each indicia portion includes pre-printed indicia thereon.

4. A cluster according to claim 1, wherein each fastener portion defines a length extending between the first end and the second end, the slit defining the closed end at a location that is positioned at less than halfway along the length when taken in the direction from the first end toward the second end.

5. A cluster according to claim 1, wherein the open end of the slit for each twist-tie of a pair are positioned on opposite ends of the pair.

* * * * *